US005675989A

United States Patent [19]

Abraskin

[11] Patent Number: 5,675,989

[45] Date of Patent: Oct. 14, 1997

[54] FINGERNAIL ADORNMENT

[76] Inventor: Alan Abraskin, 4 Sudbury Rd., Morganville, N.J. 07751

[21] Appl. No.: 596,552

[22] Filed: Feb. 5, 1996

[51] Int. Cl.[6] ..... A44C 25/00

[52] U.S. Cl. ..... 63/41; 63/DIG. 1

[58] Field of Search ..... 63/2, DIG. 1, DIG. 3; D11/27

[56] References Cited

U.S. PATENT DOCUMENTS 4,294,260 10/1981 Veatch ..... 63/2 X
5,081,853 1/1992 Salyer ..... 63/12
5,239,840 8/1993 Sutterlin ..... 63/2

FOREIGN PATENT DOCUMENTS 2276527 5/1994 United Kingdom ..... 63/2

*Primary Examiner*—Kien T. Nguyen
*Attorney, Agent, or Firm*—Myron Amer PC

[57] ABSTRACT

A fingernail-adorning display in which the fingernail and a selected display object are spaced apart by a nominally-sized chain connected therebetween, so that dangling movement as well as the content of the display object contributes display value to the manner in which the fingernail is adorned.

1 Claim, 1 Drawing Sheet

FINGERNAIL ADORNMENT

The present invention generally relates to improvements for the fashion trend popular with females of decorating fingernails allowed to grow naturally to a size presenting a display surface or, alternatively, having adhesively attached to a nominally-sized fingernail a plastic artificial nail of an appropriate size to be fashionably decorated, the improvements more particularly providing significantly greater display value to the decorated fingernail.

EXAMPLES OF THE PRIOR ART

The practice of decorating fingernails is already known, as exemplified by U.S. Pat. No. 1,238,046 issued to G. L. F. Noss for "Finger Nail Ornament" on Aug. 21, 1917, U.S. Pat. No. 2,013,290 issued to E. C. Rohrbach for "Device for Finger Nails" on Sep. 3, 1935, both relating to decorative tips adhesively secured to the user's fingernail tips, and U.S. Pat. No. 4,581,088 issued to Robert E. House for "Finger Jewels" on Apr. 8, 1986 relating to adorning the fingernail with a jewel in a setting (FIG. 9).

The aforesaid and all other known fingernail decorating techniques effectively draw attention, as intended, to the user's fingernails, but being merely surface ornamentation are limited in their display value to the artist content of the ornament.

Broadly, it is an object of the present invention to provide a fingernail decorative adornment overcoming the foregoing and other shortcomings of the prior art.

More particularly, the adornment proposed herein is displayed with degrees of movement relative to the user's fingernail so that the display value is not only a function of the artist content of the adornment, but also of its eye-catching movement, thereby contributing to a significantly enhanced display, all as will be better understood as the description proceeds.

The description of the invention which follows, together with the accompanying drawings should not be construed as limiting the invention to the example shown and described, because those skilled in the art to which this invention appertains will be able to devise other forms thereof within the ambit of the appended claims.

Figure 1:
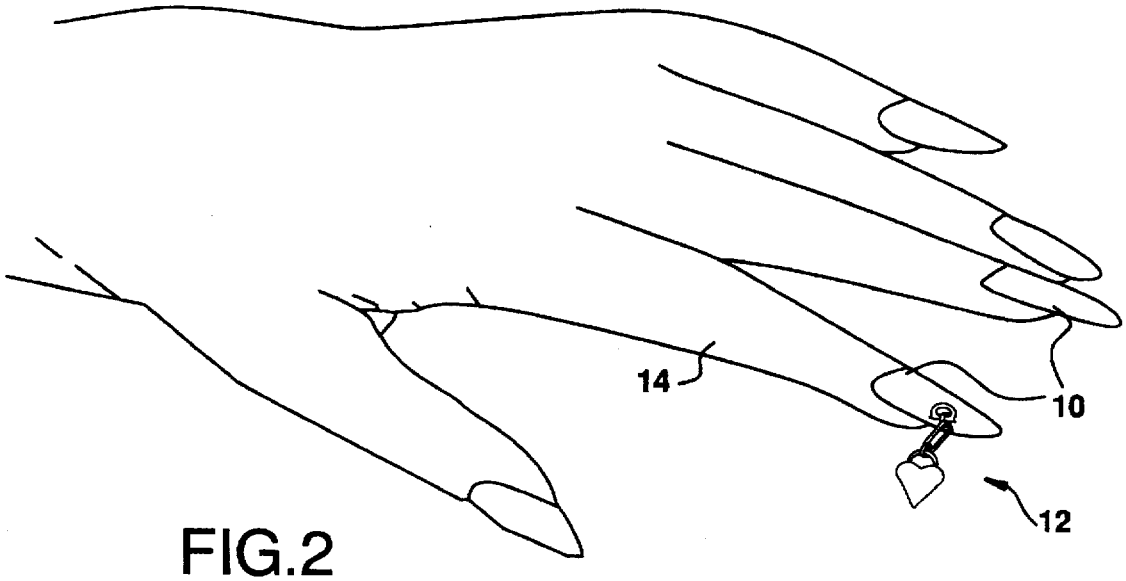
FIG. 1 is a perspective view illustrating an intended end use of the within inventive fingernail adornment.
Figure 2:
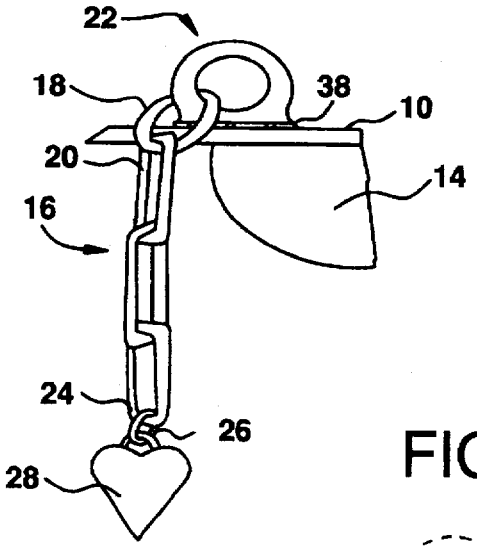
FIG. 2 is a partial side elevational view, on an enlarged scale, illustrating further structural details of the attachment of the adornment to the user's fingernail.

It is already a known fashion trend of females to allow fingernail growth to a size which facilitates decoration of the fingernail or, alternatively, the adhesive attachment in covering relation over the natural fingernail of a decorated artificial or plastic construction material fingernail. This fashion trend is exemplified by the FIG. 1 illustrated natural fingernails, individually and collectively designated 10, and more particularly the fingernail-adorning display, generally designated 12 of the user's pointing finger 14, which preferably uses a multiple-link chain 16 of a nominal selected length of approximately 1½ inches having a ring 18 attachment at a chain distal end 20 to an attaching component or connector 22, soon to be described, and at a chain proximal end 24 being appropriately attached at 26 to a selected adornment 28 such as a heart-shaped object or the like.

The fingernail-adorning heart object 28 thus is displayed in a clearance position, or a condition aptly described as "dangling" from the fingernail 10 which, in practice, contributes to significant interest or appearance-enhancing value to use of the heart object 28 as decoration for the fingernail 10. Although a multiple-link chain is preferred, as noted above, the desired "dangling" display is also achieved, to a less extent, using a shorter one-link chain and is therefore a usable alternative.

Figure 3:
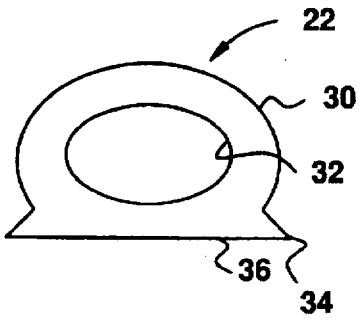
FIG. 3 is an isolated perspective view, on an enlarged scale, of the attaching component.
Figure 4:
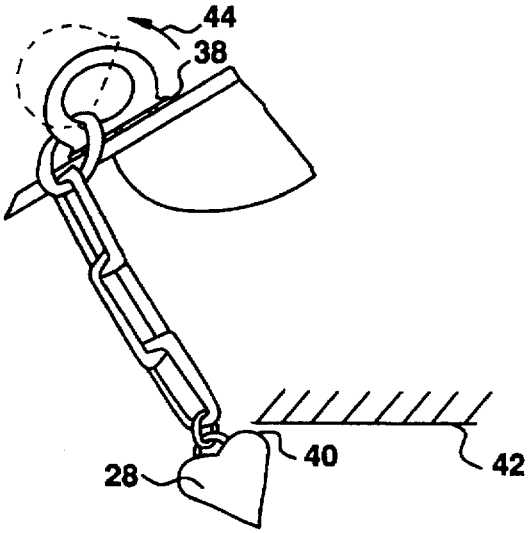
FIG. 4 is a perspective view similar to FIG. 2, illustrating the release of the attachment of the attaching component of FIG. 3, shown in full line and phantom line perspective, upon inadvertent snagging of the fingernail adornment.

The attaching component or connector 22 as best shown in the perspective view of FIG. 3 has a circular body 30 bounding an opening 32 which does not restrict movement of the ring 18 of the chain 16. The connector body 30 has a circular base 34 which presents a nominally-sized surface 36 which in a preferred embodiment is approximately ⅛ inch in diameter and is coated with a selected adhesive 38 for completing the adhesive attachment to the fingernail 10. More particularly, the adhesive 38 is selected to provide adhesion of an extent to maintain attachment of the connector 22 to the fingernail 10 to withstand a nominal pull during normal use and wear of the adornment 28, but in response to a greater pull, as will occur when the dangling adornment 28 inadvertently snags, as at 40, on an object 42, such as clothing or the like, the surface 36 detaches itself or releases from the adhesion site enabling corresponding releasing movement 44 of the connector 22, as illustrated in full line and phantom line perspective in FIG. 4.

In practice good results have been achieved using as an adhesive a glue commercially available from East Coast Labs of Greensboro, N.C.

While the fingernail adornment herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. Improvements for a fingernail-adorning display means having an operative attached condition to said fingernail, said improvements comprising a chain of a selected nominal length having opposite distal and proximal ends, a fingernail adornment attached to said chain proximal end incident to contributing to a visual display thereof in dangling relation from said fingernail, and a connector attached to said chain distal end and to a selected extent adhesively to said fingernail, said connector having a flat base adhesively connected to said fingernail of an extent to maintain attachment of said connector to said fingernail selected to withstand a pull of a prescribed extent and in response to a greater pull to permit the release thereof, and a dangling condition of said fingernail adornment in a clearance position from said adhesive connection of said connector to said fingernail to contribute to eye-attracting movement thereof as permitted by said chain connected in spanning relation between said fingernail and said fingernail adornment, whereby said dangling adornment enhances the appearance of said fingernail and detaches without injury thereto if inadvertently snagged.

* * * * *